US005996119A

United States Patent [19]

Anderberg

[11] Patent Number: 5,996,119

[45] Date of Patent: Dec. 7, 1999

[54] BARBER'S NECK STRIP AND METHOD OF USING THE SAME

[76] Inventor: Bertil I. Anderberg, 1813 Sheldon Ave., Cedar Falls, Iowa 50613

[21] Appl. No.: 08/828,324

[22] Filed: Mar. 28, 1997

[51] Int. Cl.[6] ..... A41D 13/00

[52] U.S. Cl. ..... 2/50; 2/49.1; 4/520

[58] Field of Search ..... 2/46, 48, 49.1, 2/49.2, 49.3, 49.4, 49.5, 50, 51, 52, 174, 171, 468, 129, 131, 133, 134, 136, 139, 60, 59, DIG. 11, 53; 4/520, 521

[56] References Cited

U.S. PATENT DOCUMENTS

| | | | |
|---|---|---|---|
| 1,518,293 | 12/1924 | Zang | 2/50 |
| 1,723,018 | 8/1929 | Dunlap | 2/50 |
| 2,023,279 | 12/1935 | McNutt | 2/174 |
| 2,029,417 | 2/1936 | Forster | 2/50 |
| 2,030,135 | 2/1936 | Carpenter | 450/81 |
| 3,949,875 | 4/1976 | Catania et al. | 2/50 |
| 4,958,385 | 9/1990 | Rushton, Jr. | 2/174 |

FOREIGN PATENT DOCUMENTS

| | | | |
|---|---|---|---|
| 0373824 | 6/1990 | European Pat. Off. | 2/50 |
| 816134 | 10/1951 | Germany | 2/50 |
| 953559 | 11/1956 | Germany | 2/50 |
| 1040758 | 10/1958 | Germany | 2/50 |

*Primary Examiner*—Gloria M. Hale

*Attorney, Agent, or Firm*—Zarley, McKee, Thomte, Voorhees & Sease

[57] ABSTRACT

A barber's neck strip has an elongated thin elastic strip of flexible material having opposite ends, and a patch of pressure sensitive adhesive adjacent each of said ends so that when said strip is positioned around the neck of a person and said patches are superimposed on each other, the ends of said strip will be joined to hold said strip around the neck of the person. The method of use of the neck strip involves positioning the strip around the neck of a person and stretching the strip longitudinally until the patches can be placed in superimposed positions, and applying pressure on the strip opposite to the patches to force the patches together to hold the strip around the neck of the person.

14 Claims, 1 Drawing Sheet

BARBER'S NECK STRIP AND METHOD OF USING THE SAME

BACKGROUND OF THE INVENTION

Conventional barbers place a paper neck strip around the neck of the person whose hair is to be cut or otherwise treated. A chair cloth large enough to cover the chest, lap and shoulders of the person is then placed in position and overlaps the lower portion of the neck strip. The chair cloth is then joined by a clip, snaps or the like at the rearward portion of the person's neck. One of the principal objects of the neck strip is to prevent the chair cloth from touching the neck of the person for sanitary reasons, in that the chair cloth is used for a plurality of persons. Thus, the chair cloth is the primary means for holding the neck strip in place because there are no fastening devices on the neck strip. This invites some lack of consistency in how well a given installation of the strip protects the neck from contact with the chair cloth.

Another shortcoming of existing neck strips is that they lose their strength and may pull apart upon becoming wet from any hair dressing or any other source.

It is therefore a principal object of this invention to provide a barber's neck strip that can of itself be secured to the neck of a person, and which is impervious to moisture.

A further object of this invention is to provide a neck strip and method of using the same which is easy to install, and is effective to hold the strip in place.

A further object of this invention is to provide a neck strip that will not injure the skin of the person using the same, and which will be completely sanitary.

These and other objects will be apparent to those skilled in the art.

SUMMARY OF THE INVENTION

This invention involves a barber's neck strip which has an elongated thin elastic strip of flexible material having opposite ends, and a patch of pressure sensitive adhesive adjacent each of said ends so that when said strip is positioned around the neck of a person and said patches are superimposed on each other, the ends of said strip will be joined to hold said strip around the neck of the person.

The method of use of the neck strip involves positioning the strip around the neck of a person and stretching the strip longitudinally until the patches can be placed in superimposed positions, and applying pressure on the strip a opposite to the patches to force the patches together to hold the strip around the neck of the person.

DESCRIPTION OF THE PREFERRED EMBODIMENT

Figure 1:
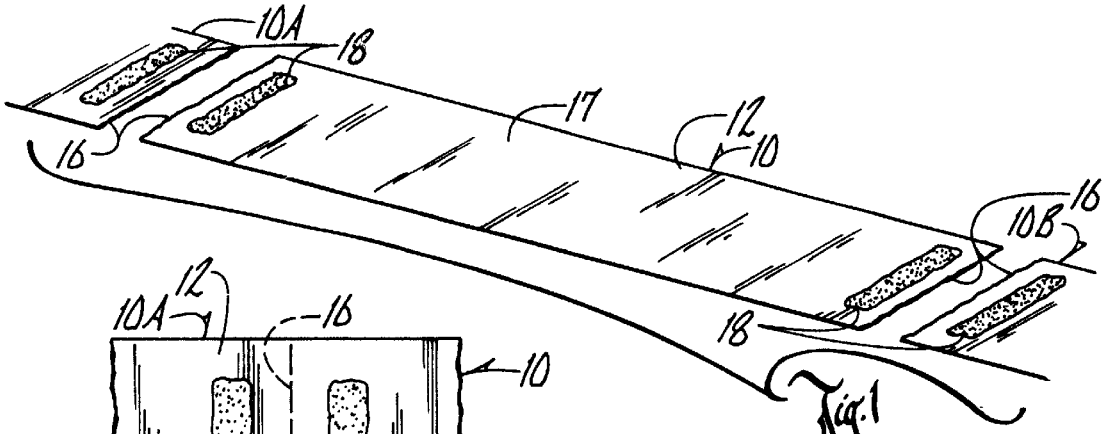
FIG. 1 is an exploded perspective view of the barber strip of this invention separated from adjacent strips.
Figure 2:
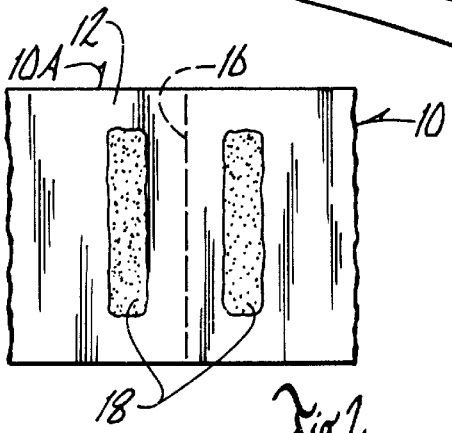
FIG. 2 is a partial plan view of the ends of two connected strips.

The strip 10 (FIG. 1) is comprised of flexible, thin crepe paper or the like which has a slight degree of elasticity, and which is made impervious to water by any suitable conventional non-chemically active sealing material. Strip 10 has an inner surface 10, an outer surface 12, opposite ends 16, and a center portion 17. The ends 16 can be serrated so as to be detachably secured to strips 10A or 10B in a continuous roll of strips if desired.

Closely adjacent each end 16 on inner surface 12 is a patch 18 of pressure sensitive adhesive which is dry in nature. Patches 18 should be made of a chemically inactive material.

In operation, strip 10 is removed from a roll of continuous strips (not shown, but see FIG. 1) by tearing strip 10 from adjacent strip 10A or 10B, as the case may be. The barber, who is usually standing to the rear of person 20, grips the strips 10 by the ends 16 adjacent the patches 18; and positions the inner surface 12 of the strip 10 on the neck 22 of the person by placing the center 17 of the strip on the forward portion 24 of the neck.

Figure 3A:
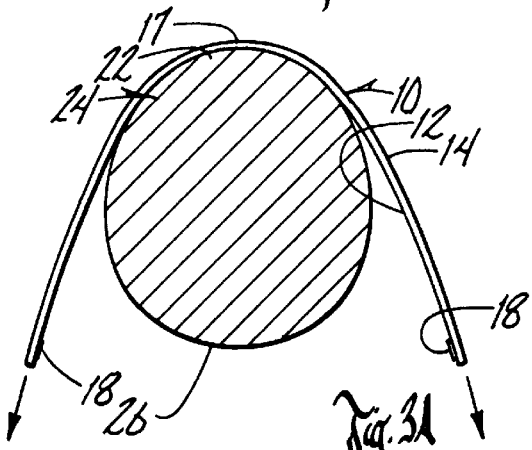
FIGS. 3A and 3B are cross-sectional views showing the steps of use of the strip.
Figure 3B:
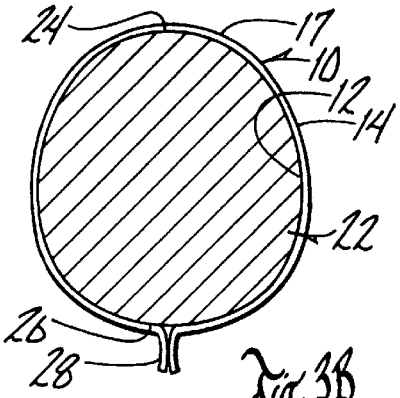
Figure 4:
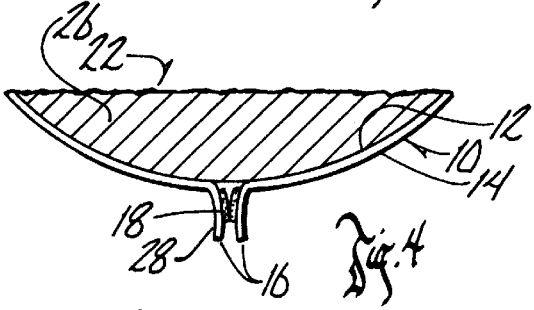
FIG. 4 is an enlarged scale view of a portion of FIG. 3B.
Figure 6:
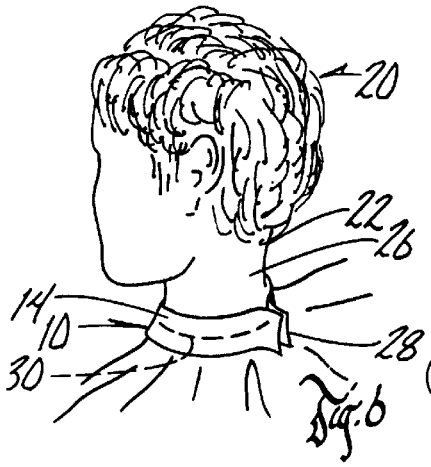
FIG. 6 is a rearward perspective view of a person upon which a strip has been placed.
Figure 5A:
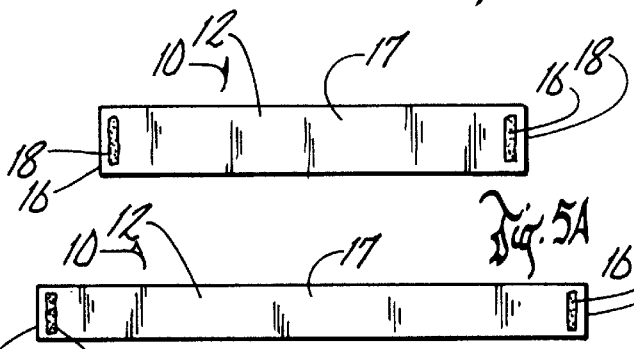
FIGS. 5A and 5B are reduced scale plan views of a strip before and after being stretched.
Figure 5B:
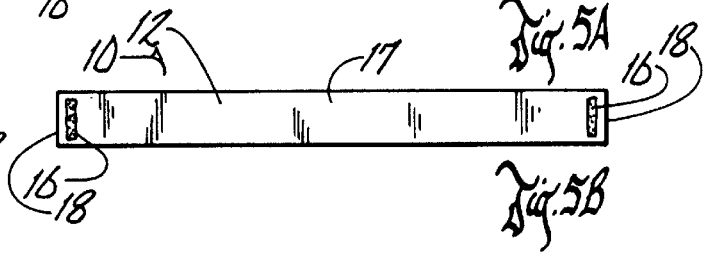

The barber then pulls the ends of the strip 10 in the direction of the arrows in FIG. 3A, thus changing the length and the width of the strip from an initial shape (FIG. 5A) to an extended length (FIG. 5B) so that the extended length is sufficient to allow the strip 10 to reach around to the back portion 26 of the neck, and sufficient to allow the radially extending tab 28 (FIGS. 4 and 6) to be formed. By grasping the ends 16 adjacent the patches 16, the patches also are stretched and this enhances their ability to be mechanically bonded together when pressure is applied.

The patches 18 are superimposed over each other within tab 28. The barber pinches tab 28 between his or her thumb and forefinger to bond the patches together, and hence, to hold the strip 10 in a fixed and stabilized position around the neck 22 of the person 20. The chair cloth can then be placed around the shoulders of the person 20, and adjacent the strip 10 (see the dotted lines 30 in FIG. 6).

If water comes into contact with strip 10 while it is in place, it will not pull apart or otherwise be damaged.

When the haircut or hair service is completed, the chair cloth is conventionally removed. The barber can then manually pull tab 28 apart, and the strip 10 is ready for disposal.

The dimensions of strip 10 in its unstretched condition (FIG. 5A) are preferably 10 inches long and at least 2 and ¾ inches wide. This width may be reduced as the strip 10 is stretched to a length of 16–18 inches (FIG. 5B), but this will still leave an effective width for the strip to perform its intended function.

From the foregoing, it is seen that this device will accomplish all of the stated objectives.

What is claimed is:

1. A barber's neck strip, comprising, an elongated thin elastic strip comprised of crepe paper and having opposite ends, and a patch of pressure sensitive adhesive adjacent each of said ends so that when said strip is positioned around the neck of a person and said patches are superimposed on each other, the ends of said strip will be joined to hold said strip around the neck of the person, said crepe paper being made impervious to moisture so that it will not pull apart upon becoming wet from any source.

2. The device of claim 1 wherein said adhesive is dry.

3. The device of claim 1 wherein said adhesive is not chemically active.

4. The device of claim 1 wherein said adhesive is dry and is not chemically active.

5. The device of claim 1 wherein said strip is not chemically active.

6. The device of claim 1 wherein said patches are spaced from the ends of said strip to permit the opposite ends thereof to be grasped to stretch said strip without grasping said patches.

7. The device of claim 1 wherein said strip is one of a plurality of strips in an elongated composite strip length with each strip being separated from adjacent strips by transversely extending tear lines between adjacent ends of adjacent strips.

8. The device of claim 1 wherein said tear lines are a row of serrations.

9. The device of claim 1 wherein said strip has opposite surfaces, and said patches are both on the same surface.

10. The device of claim 7 wherein the initial length of said strip is less than the circumference of neck of said person.

11. The device of claim 1 wherein the initial width of said strip is about 2 and ¾ inches and the initial length is about 10 inches.

12. A method of using a barber's neck strip comprised of an elongated thin elastic strip consisting of a single strip of flexible material having opposite ends, and a patch of pressure sensitive adhesive adjacent each of said ends, comprising the steps of:

making said material impervious to moisture so that it will not pull apart upon becoming wet from any source, positioning said strip around the neck of a person and stretching said strip longitudinally until said patches can be placed in superimposed positions, and applying pressure on said strip opposite to said patches to force said patches together to hold said strip around the neck of said person.

13. The method of claim 12 wherein said strip is stretched sufficiently so that said strip is long enough to circumscribe the neck of said person and to permit said ends to be bent outwardly from the neck of the person to permit said patches to be superimposed upon each other.

14. The method of claim 12 wherein said patches are also stretched longitudinally when said strip is stretched.

* * * * *

UNITED STATES PATENT AND TRADEMARK OFFICE

CERTIFICATE OF CORRECTION

PATENT NO. : 5,996,119

DATED : December 7, 1999

INVENTOR(S) : ANDERBERG, Bertil I.

It is certified that error appears in the above-identified patent and that said Letters Patent is hereby corrected as shown below:

In column 3, line 16, change the numeral "7" to the numeral - 5 -.

Signed and Sealed this

Fifteenth Day of August, 2000

*Attest:*

Q. TODD DICKINSON

*Attesting Officer*

*Director of Patents and Trademarks*